United States Patent [19]

Stewart

[11] 4,162,559

[45] Jul. 31, 1979

[54] CARDING APPARATUS

[75] Inventor: David B. Stewart, Newtyle, Scotland

[73] Assignee: Wm. R. Stewart & Sons (Hacklemakers) Limited, Dundee, Scotland

[21] Appl. No.: 840,027

[22] Filed: Oct. 6, 1977

[51] Int. Cl.[2] ..... D01G 1508; D01G 15/24

[52] U.S. Cl. ..... 19/113; 19/107

[58] Field of Search ..... 19/112, 113, 114, 97, 19/129 R

[56] References Cited

U.S. PATENT DOCUMENTS

| | | | |
|---|---|---|---|
| 2,097,254 | 10/1937 | Platt | 19/113 |

FOREIGN PATENT DOCUMENTS

| | | | |
|---|---|---|---|
| 2604465 | 8/1976 | Fed. Rep. of Germany | 19/113 |
| 642342 | 9/1930 | France | 19/113 |
| 622553 | 6/1961 | Italy | 19/113 |
| 1696 | of 1856 | United Kingdom | 19/114 |
| 862026 | 3/1961 | United Kingdom | 19/114 |
| 1384247 | 2/1975 | United Kingdom | 19/104 |

*Primary Examiner*—Dorsey Newton

*Attorney, Agent, or Firm*—Diller, Ramik & Wight

[57] ABSTRACT

A carding flat for use with textile carding machinery comprises an array of individual pins each secured in a respective aperture in a flat support.

19 Claims, 5 Drawing Figures

CARDING APPARATUS

BACKGROUND OF THE INVENTION

Figure 1:
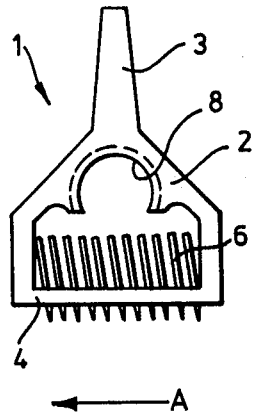

Conventional carding apparatus used in the manufacture of textile yarn from short staple fibres comprises a cylinder having a surface which carries an array of carding points. As the cylinder rotates, the carding surface picks up fibres and carries them into engagement with a series of carding flats which are also provided with carding points. The carding flats are moved in the same direction as that part of the carding surface of the cylinder with which they engage, but at a lower speed. Fibres carried by the cylinder are therefore combed by the carding surfaces of the cylinder and flats, so that impurities or tangles in the fibre are removed on to the flats. The flats themselves are driven along an endless path and, on disengaging from the carding cylinder are driven past a brush which frees the surfaces of the flats from the waste material.

Hitherto, the surfaces of carding flats have been composed of a flexible web, which is secured to a rigid substrate, the points being in the form of staples projecting through the web from the side fixed to the substrate. Alternatively, the carding surfaces of the flats have been provided by metal strips having saw-tooth edges secured in the surface of a substrate. Both these constructions have suffered from the disadvantage that the fibres removed from the surface of the cylinder are difficult to separate from the carding flat because in the former case the points are of uniform cross section and in the latter case the saw tooth edges inevitably include burrs which trap the fibres.

SUMMARY OF THE INVENTION

Broadly in accordance with the present invention we provide a carding flat which comprises a rigid substrate carrying a plurality of individual pins each secured in a respective aperture in the substrate.

More particularly the present invention provides a textile carding machine comprising a rotatable carding cylinder and a plurality of carding flats each comprising a rigid substrate provided with apertures and an array of carding pins projecting through and fixed in the apertures, the carding flats being drivable along an endless path and cooperating with the surface of the carding cylinder along part of the path to effect carding of fibres carried on the surface of the carding cylinder.

Preferably, the pins are mounted in the support substrate of the flats by using the process disclosed and claimed in our British Patent Specification No. 1298561. That is to say, the substrate is provided with holes larger in diameter than the pins, and the pins are secured in the holes by means of a filler such as an epoxy resin.

Preferably the pins are tapered in the direction away from the substrate. The ends of the pins embedded in the flat will normally be circular in cross section. The free ends of the pins however may be of circular or elliptical cross-section. If the ends of the pins are of elliptical cross-section, the pins are preferably arranged in the substrate with the major axes of the ellipses aligned parallel to the direction of movement of the flats. Advantageously the pins are inclined forwardly in the direction of rotation of the main carding cylinder.

It has unexpectedly been found that the use of tapered steel pins so improves the carding action of the flat that fewer points per square inch will achieve the desired effect. Apart from reducing the cost of each flat, there is less damage caused to the fibres being processed with a consequent improvement in efficiency.

The points of the pins in each flat may be set so that they all lie in a cylindrical surface concentric with the axis of the carding cylinder with which the flats are to be used. If desired, the points may be ground to alter the geometry of the surface in which the points lie, thereby modifying the carding effect of the flat.

The pins are preferably arranged in the carding flats in a number of parallel rows, each row extending substantially parallel to the axis of the main carding cylinder. Usually each row will contain at least ten pins per inch and each flat will contain from 5 to 25 rows of pins per inch along its length.

The substrate in which the pins are mounted is preferably of metal, for example aluminium, and may be shaped to conform to the surface of the carding cylinder in conjunction with which the flat is to be used.

Preferably, the rigid substrate comprises an elongated hollow support, and the pins are arranged in a strip extending along the length of the support in apertures connecting the internal and external surfaces of the support.

Substrates of this construction are conveniently formed from extruded aluminium or aluminium alloy. The hollow support may be provided with an integral stiffening member extending longitudinall along the support. This stiffening member may, for example, be in the form of a fin projecting from the support or, alternatively, it may be formed by two converging walls of the support.

The hollow support may be adapted at each end for connection to a bearing member. These bearing members may be connected together to form a series of similar carding flats into a chain.

In the preferred embodiment of the invention each bearing member comprises a bearing box rigidly secured to one end of the support and adapted to slide along a track mounted on a carding machine. The track will usually be mounted on or form part of a gable of the carding cylinder of the machine.

Figure 2:
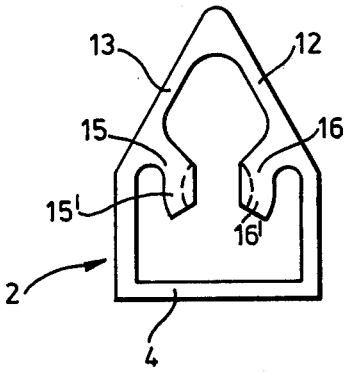
Figure 3:
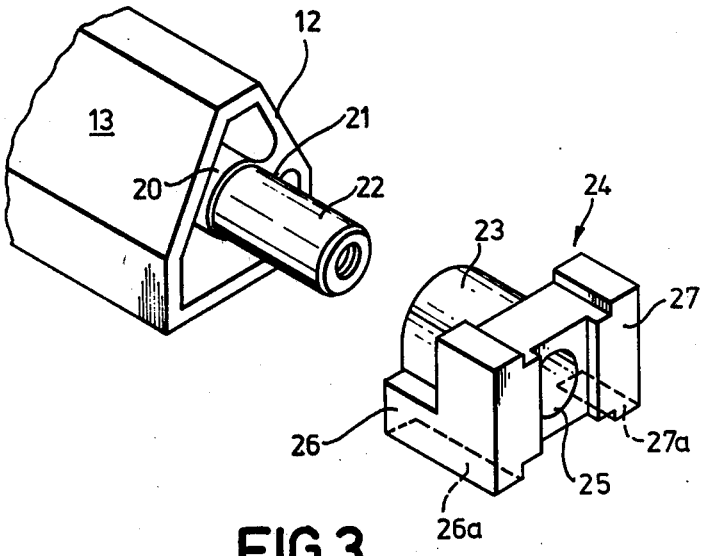
Figure 4:
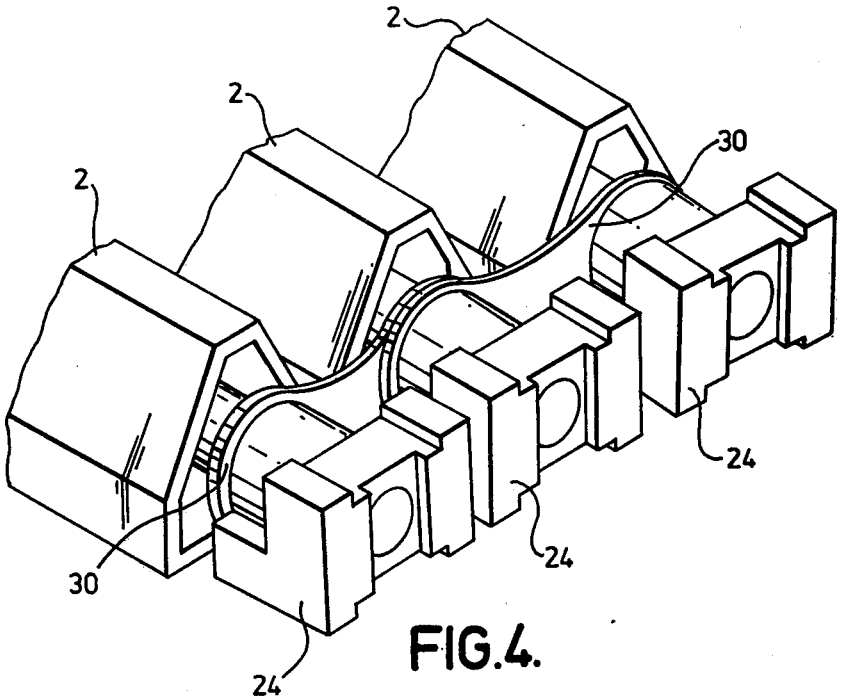
Figure 5:
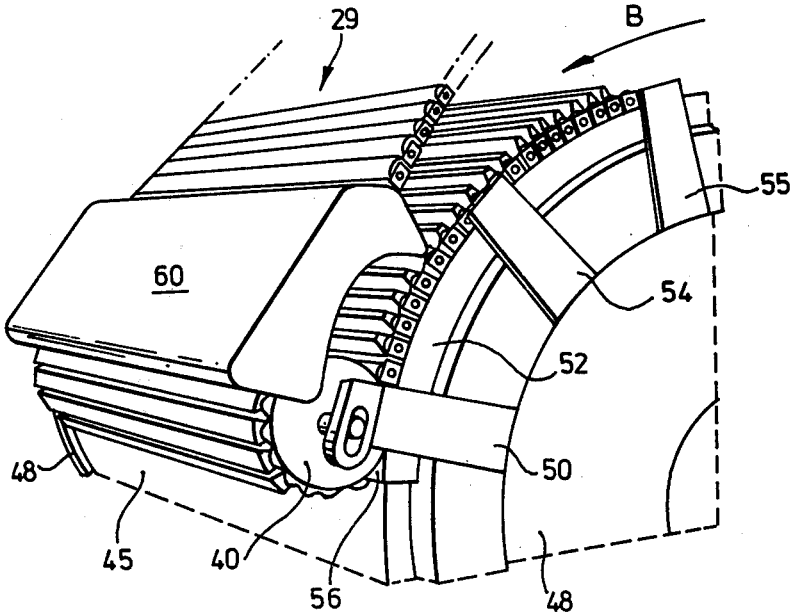

In order that the invention may be better understood, embodiments thereof will now be described, by way of example only, with reference to the drawings in which:

FIG. 1 represents a transverse cross section through a first embodiment of a carding flat according to the invention, FIG. 2 represents a transverse cross section through a second embodiment of a carding flat according to the invention, FIG. 3 represents an "exploded" perspective view of one end of a third embodiment of a carding flat according to the invention, FIG. 4 indicates schematically a perspective view of a carding chain incorporating the flats of FIG. 3, and FIG. 5 is a schematic perspective view of a carding machine incorporating the chain of FIG. 4.

Referring to FIG. 1 a carding flat 1 comprises a hollow rigid support 2 of extruded aluminium. An integral fin 3 projects from one surface of the support 2 and extends along the length thereof. A flat face 4 of the support 2 opposite the fin 3 is provided with an array of apertures connecting the internal and external surfaces of the support 2. A steel pin 6 is fixed in each of the apertures either by frictional contact with the walls of the apertures or by means of a filler as described in our earlier British Patent Specificaton No. 1298561. The pins 6 are arranged in parallel lines and form a strip of pins along the flat face 4 of the support.

In the embodiment illustrated, the pins 6 are all inclined to the normal to the surface of the flat face 4 in the direction of the arrow A, which is the direction of movement of the flat 1 when in use. If desired the pins 6 may be mounted perpendicularly to the flat face 4.

The interior surface of the support 2 includes a partly cylindrical recess 8 which extends axially along the support 2. The ends of the recess 8 are counter-bored, as indicated by the broken lines 10, to receive cylindrical mounting members, described in more detail below.

FIG. 2 illustrates the body 2 of a further embodiment of the invention which is also formed from extruded aluminium. (The apertures and pins 6 have been omitted from this drawing for clarity). In this embodiment, two walls 12, 13 of the support 2 converge towards the top of the support 2 to form a stiffening member for the support 2. Two internal ribs 15, 16 project from the interior wall of the support 2. Each rib 15, 16, carries an integral flange 15', 16' and the ends of these flanges are counter bored, as indicated by the broken lines, to receive cylindrical mounting members, in the manner described below.

FIG. 3 illustrates a still further embodiment of the invention. The support 2 is formed of extruded aluminium and is stiffened by two converging walls 12, 13. One wall 12 is connected to a cylinder 20 by means of a neck portion 21. The cylinder 20 runs along the centre of the support 2 and is counterbored at each end of the same manner as the embodiments of FIGS. 1 and 2.

One end of a pin 22 composed of a rigid material such as iron or steel is secured in the counter bore in each end of the support 2, either by friction or by means of an adhesive. The free ends of the pins 22 are secured in bearing members of conventional construction. In the embodiment illustrated in FIG. 3, the bearing members are in the form of boxes 24 each of which is provided with a partly-cylindrical body 23 which define a bore 25 for receiving the pin 22. The pin may be secured in the bore 25 by friction or by an adhesive. The boxes 24 include two integral end pieces 26, 27 the under surfaces 26*a*, 27*a* of which are flat and lie in the same plane.

In use, a set of flats 1 is assembled into an endless chain 29 by means of a set of flat links 30 as illustrated in FIG. 4. Each link 30 includes two apertures through which pass the pins 22 of two adjacent flats, and is positioned between the supports 2 and the boxes 24 of the flats. The flats are linked together so that the flat faces 4 form the external surface of the chain 29.

As illustrated in FIG. 5, the chain 29 is used in a carding machine which comprises a carding roller 45 the cylindrical surface of which carries an array of carding points. The roller 46 is rotatably mounted in gables 48.

The chain 29 is entrained over a roller 40 on each end of which is mounted a drive sprocket. The teeth of the drive sprockets project between the cylindrical bodies 23 of the boxes 24 of each pair of adjacent flats. The roller 40 is attached to the gables 48 by means of brackets 50. A track 52 is also mounted on each gable 48 by means of the brackets 50 which carry the roller 40 and by means of a set of further brackets 54, 55. Each track has a cylindrical upper surface 56 which engages the flat under surfaces 26*a*, 27*a* of the boxes 24 of the flats in the lower run of the chain 29. The track 52 is adjustable in the brackets 50, 54, 55 so that the radial spacing between the flat faces 4 of the flats 1 in the lower run of the chain 29 may be adjusted. In practice the tracks 52 are adjusted to provide a clearance of from 5 to 15 thousandths of an inch between the points on the carding roller 45 and the ends of the pins 6 on the flats 1.

The chain 29 passes around a further roller (not shown) similar to the drive roller 40 and positioned further around the circumference of the carding roller 45 so that the lower run of the chain 29 extends parallel to the surface of the carding roller over a distance of about 120°.

The carding roller 45 is driven anti-clockwise as shown in FIG. 5 and the chain 29 is driven in the direction of the arrow B at a lower speed than the surface of the roller 45.

The carding flats travel along the tracks 52 and are held thereon by gravity and by the tension in the chain 29. The pins 6 on the flats interact with the carding points on the surface of the carding roller and comb through the fibres thereon. If desired, the orientation of the boxes 24 relative to the supports 2 can be adjusted so the clearance between the pins of the flat and the pins of the carding roller 45 is greater at the leading edge of each flat than at the trailing edge. The flat faces 4 then form a nip with the surface of the carding roller 45 which improves the carding action of the flats 1.

A brush mechanism 60 is mounted above the drive roller 40 and engages with the upper arm run of the chain 29 to remove material from the flat surfaces 4 of each carding flat.

I claim:

1. A carding flat comprising a rigid substrate defining an array of apertures and a plurality of individual pins each secured in a respective one of said apertures in the substrate, said substrate being an elongated member having a longitudinal axis and axially opposite hollow end portions defining hollow areas, said end portions each including an internal axially extending partially cylindrical surface opening in a direction generally transversely of said longitudinal axis into the hollow area of each hollow end portion, and axial ends of each cylindrical surface terminating at a counter bored cylindrical surface likewise opening in a direction generally transversely of the longitudinal axis into the hollow area of each hollow end portion.

2. The carding flat as defined in claim 1 wherein said elongated member is of a one-piece extruded construction.

3. The carding flat as defined in claim 1, wherein said entire elongated member is generally hollow, and said apertures open into said elongated member along the length thereof.

4. The carding flat as defined in claim 1 wherein said elongated member carries an integral stiffening portion along the length thereof.

5. The carding flat as defined in claim 4 wherein said stiffening portion is a fin projecting from the elongated member.

6. A carding flat comprising a rigid substrate defining an array of apertures and a plurality of individual pins each secured in a respective one of said apertures in the substrate, said substrate being an elongated member having a longitudinal axis and axially opposite hollow end portions defining hollow areas, said end portions each including a pair of mounting flanges directed inwardly into each hollow area, and said pair of mounting flanges each defining means for supporting the substrate for pivotal movement relative to a movable support adapted to be disposed adjacent a carding cylinder.

7. The carding flat as defined in claim 6 wherein said elongated member is of a one-piece extruded construction.

8. The carding flat as defined in claim 1 wherein said supporting means are opposing faces of said pair of flanges adapted to receive therein cylindrical mounting members.

9. The carding flat as defined in claim 1 wherein said elongated member is of a one-piece extruded construction, and said supporting means are opposed faces of said pair of flanges adapted to receive therein cylindrical mounting members.

10. The carding flat as defined in claim 1 wherein said entire elongated member is generally hollow, sand said apertures open into said elongated member along the length thereof.

11. The carding flat as defined in claim 1 wherein said elongated member carries an integral stiffening portion along the length thereof.

12. The carding flat as defined in claim 11 wherein said stiffening portion is formed by two converging walls of said elongated member.

13. A carding flat comprising a rigid substrate defining an array of apertures and a plurality of individual pins each secured in a respective one of said apertures in the substrate, said substrate being an elongated member having a longitudinal axis and axially opposite hollow end portions defining hollow areas, a neck projecting in a direction generally transversely of said longitudinal axis into the hollow area of each hollow end portion, and each neck carrying means for supporting the substrate for pivotal movement relative to a movable support adapted to be disposed adjacent a carding cylinder.

14. The carding flat as defined in claim 13 wherein said elongated member is of a one-piece extruded construction.

15. The carding flat as defined in claim 13 wherein said supporting means is a bore adapted to receive therein cylindrical mounting members.

16. The carding flat as defined in claim 13 wherein said entire elongated member is generally hollow, and said apertures open into said elongated member along the length thereof.

17. In a textile carding machine comprising a rotatable carding cylinder and a plurality of carding flats, the carding flats being drivable along an endless path and cooperating with the surface of the carding cylinder along part of the path to effect carding of fibres carried on the surface of the carding cylinder, each of said carding flats including a rigid substrate defining an array of apertures and a plurality of individual pins each secured in a respective one of said apertures in the substrate, said substrate being an elongated member having a longitudinal axis and axially opposite hollow end portions defining hollow areas, said end portions each including an internal axially extending partially cylindrical surface opening in a direction generally transversely of said longitudinal axis into the hollow area of each hollow end portion, and axial ends of each cylindrical surface terminating at a counter bored cylindrical surface likewise opening in a direction generally transversely of the longitudinal axis into the hollow area of each hollow end portion.

18. In a textile carding machine comprising a rotatable carding cylinder and a plurality of carding flats, the carding flats being drivable along an endless path and cooperating with the surface of the carding cylinder along part of the path to effect carding of fibres carried on the surface of the carding cylinder, each of said carding flats including a rigid substrate defining an array of apertures and a plurality of individual pins each secured in a respective one of said apertures in the substrate, said substrate being an elongated member having a longitudinal axis and axially opposite hollow end portions defining hollow areas, said end portions each including a pair of mounting flanges directed inwardly into each hollow area, and said pair of mounting flanges each defining means for supporting the substrate for pivotal movement relative to a movable support defining said endless path adjacent said carding cylinder.

19. In a textile carding machine comprising a rotatable carding cylinder and a plurality of carding flats, the carding flats being drivable along an endless path and cooperating with the surface of the carding cylinder along part of the path to effect carding of fibres carried on the surface of the carding cylinder, each of said carding flats including a rigid substrate defining an array of apertures and a plurality of individual pins each secured in a respective one of said apertures in the substrate, said substrate being an elongated member having a longitudinal axis and axially opposite hollow end portions defining hollow areas, a neck projecting in a direction generally transversely of said longitudinal axis into the hollow area of each hollow end portion, and each neck carrying means for supporting the substrate for pivotal movement relative to a movable support defining said endless path adjacent said carding cylinder.

* * * * *